United States Patent [19]

Lior

[11] Patent Number: 4,845,787

[45] Date of Patent: Jul. 11, 1989

[54] HIGH FLOW, LOW TURBULENCE SWIM-IN-PLACE POOL OPERATION METHOD

[75] Inventor: David Lior, 430 Smithwood Dr., Beverly Hills, Calif. 90212

[73] Assignee: David Lior and Stanley Zipser, Los Angeles, Calif. ; a joint venture

[21] Appl. No.: 249,204

[22] Filed: Sep. 23, 1988

Related U.S. Application Data

[63] Continuation of Ser. No. 148,157, Jan. 29, 1988, abandoned, which is a continuation of Ser. No. 896,761, Aug. 14, 1986, abandoned.

[51] Int. Cl.[4] ..... E04H 3/18

[52] U.S. Cl. ..... 4/488; 417/320

[58] Field of Search ..... 4/488, 489, 497, 491, 4/496; 405/79, 83, 99, 106; 417/320

[56] References Cited

U.S. PATENT DOCUMENTS

| | | | |
|---|---|---|---|
| 722,232 | 3/1903 | Hoeglauer | 4/544 |
| 1,002,472 | 9/1911 | Thompson et al. | 417/320 |
| 1,331,270 | 2/1920 | Lippincott | 4/496 X |
| 1,731,554 | 10/1929 | Wheeler | 4/496 X |
| 2,415,592 | 2/1947 | Moenecke | 417/320 |
| 3,783,623 | 1/1974 | Ogden | 405/83 |
| 3,802,697 | 4/1974 | LeMehaute | 4/491 X |
| 3,913,332 | 10/1975 | Forsman | 4/491 X |

*Primary Examiner*—Charles E. Phillips
*Attorney, Agent, or Firm*—Gene W. Arant

[57] ABSTRACT

A swim-in-place pool has an inlet opening to the swimming area, which is comparable in width and height to the space that would be occupied by a swimmer's body. Water is driven through the inlet opening at a velocity which is substantially constant throughout the cross-sectional area of the opening.

The illustrated apparatus includes a housing providing an annular cavity within which a circular water advancing means is revolvably disposed. The swimming space lies essentially along a diameter of the annular cavity. The inlet opening is provided at one end of the swimming space for receiving water from the annular cavity, and an outlet opening is provided at the other end to return water to the annular cavity.

7 Claims, 5 Drawing Sheets

HIGH FLOW, LOW TURBULENCE SWIM-IN-PLACE POOL OPERATION METHOD

This is a continuation of co-pending application Ser. No. 148,157 filed on Jan. 28, 1988 which was a continuation of Ser. No. 896,761, filed Aug. 14, 1986.

BACKGROUND OF THE INVENTION

Swim-in-place pools are now well known, at least in the Sun Belt states. The concept is similar to ride-in-place bicycles or, for that matter, to the use of a wind tunnel to test an airplane. That is, the swimmer stays in essentially a fixed position while the water in which he is suspended is pumped past him in a continuous stream.

As known in present commercial products, the swim-in-place pool is provided by circulating water in only one particular direction while the swimmer's body is oriented to swim in the opposite direction, i.e., upstream. The water circulation is conventionally accomplished by means of a pipe loop within which a pump is located, the pump being driven by an electric motor.

Some manufacturers presently manufacture a swim-in-place pool in the form of a large plastic bathtub whose length is in excess of ten feet. The pipe loop is located exterior to the tube and is connected to the respective ends of the tub. The pipes are generally two or three inches in diameter, and the motor rating is in the approximate range of eight to ten horsepower.

In the conventional technology the incoming stream of water which the swimmer confronts is essentially in the form of a jet. It is necessary for the swimmer, in effect, to position himself on top of the jet stream, since water on both sides of the stream is relatively stationery. Some swimmers tire from this endeavor in a very few minutes. Others find the experience unpleasant.

SUMMARY OF THE INVENTION

There are several important concepts of the present invention.

One concept is that, in order to simulate the swimming conditions of a real swimming pool, it is necessary to have a water stream which is considerably wider than the swimmer's body, so that the relative velocity between the swimmer's body and the water will be substantially the same for all parts of his body.

Another concept is that the turbulent flow associated with simply pointing a jet stream into a large body of water represents a condition that is foreign to regular swimming pools, and should therefore be avoided.

A further concept is that a displacement pumpimg method may be advantageously utilized, in order to move a larger body of water with a much smaller amount of energy.

Still another concept of the invention is to utilize a displacement type of pumping apparatus in the form of a rotating ring, with the designated swimming space lying inside the ring along a diameter thereof.

A still further concept of the invention is that the return path of the water within which the pumping action is accomplished should have a cross-sectional area which is comparable to that of the swimming space that is necessarily occupied by the swimmer's body.

The object of the invention, therefore, is to provide both a method and an apparatus for swim-in-place pools, which will more nearly simulate the swimming conditions of a real pool, which will bring greatly increased comfort and satisfaction to the user, and which will be reasonably economical and efficient insofar as the manufacture, installation, operation, and maintenance of the equipment are concerned.

DRAWING SUMMARY

PREFERRED EMBODIMENT—SCHEMATIC ILLUSTRATION OF OPERATION

Although the presently preferred form of apparatus in accordance with the invention is shown in detail in FIGS. 1 through 9 of the drawings, reference will first be made to FIG. 10 which illustrates in a schematic fashion the operation of this apparatus.

Figure 10:
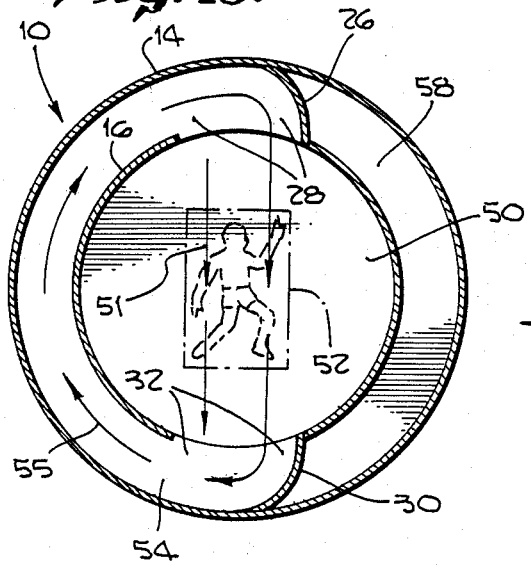
FIG. 10 is a schematic plan view which schematically illustrates the operation and manner of use of the embodiment of FIGS. 1–9.

As shown in FIG. 10, a circular housing 10 has a circular outer wall 14 and a concentric circular inner wall 16. At one point on the circumference of the housing 10 (at its top as shown in FIG. 10) an obstacle 26 extends between walls 14 and 16, and opposite the obstacle 26 the inner wall 16 has an opening 28. At an opposite point on the housing circumference (its bottom as seen in FIG. 10) there is an obstacle 30 which extends between outer wall 14 and inner wall 16. Opposite the obstacle 30 the inner wall 16 has an opening 32.

As shown schematically in FIG. 10, the entire space inside the inner wall 16 is designated by numeral 50, and is filled with water. That portion of space 50 which lies directly between the openings 28 and 32 is designated as swimming space 52, and the central portion of space 52, indicated by dotted lines, is shown as being occupied by a swimmer.

The space between walls 14 and 16 which communicates with the openings 28 and 32 is designated by numeral 54, and is the pumping and return passageway or channel for water flowing through the swimming space. FIG. 10 shows the swimmer headed toward opening 28, and arrow 51 shows the water flowing from opening 28 toward and into opening 32.

For convenient reference the opening 28 or its equivalent will be referred to hereinafter as the water inlet opening, while opening 32 or equivalent will be identified as the water outlet opening. Thus the terms "inlet" and "outlet" are used with reference to the water flow that takes place inside the swimming space 50. It will therefore be seen that within the retrun passageway 54 the direction of water flow as shown by arrow 55 is from outlet opening 32 to inlet opening 28.

There is another space between walls 14 and 16 on the closed side of obstacles 26 and 30 which is designated by the numeral 58. This space, in the preferred embodiment, is not occupied by water. However, as will later be described, the water pumping apparatus is of generally ring-shaped configuration and occupies the annular space between walls 14 and 16. Hence, the pumping apparatus is in part located within the space 58, although there is no water in that space.

DETAILED DESCRIPTION—FIGS. 1-9

Reference is now made to drawing FIGS. 1 through 9 which illustrate in detail the presently preferred apparatus of the invention.

A flat circular bottom wall 12 closes the bottom of the inner side wall 16, thus retaining water in the space 50. Outer side wall 14 is truncated on its lower edge, and a flat circular bottom wall 13 of annular configuration closes the space between the lower edge of outer side wall 14 and inner side wall 16. See FIG. 3. Thus, water is retained in the return passageway 54.

Figure 2:
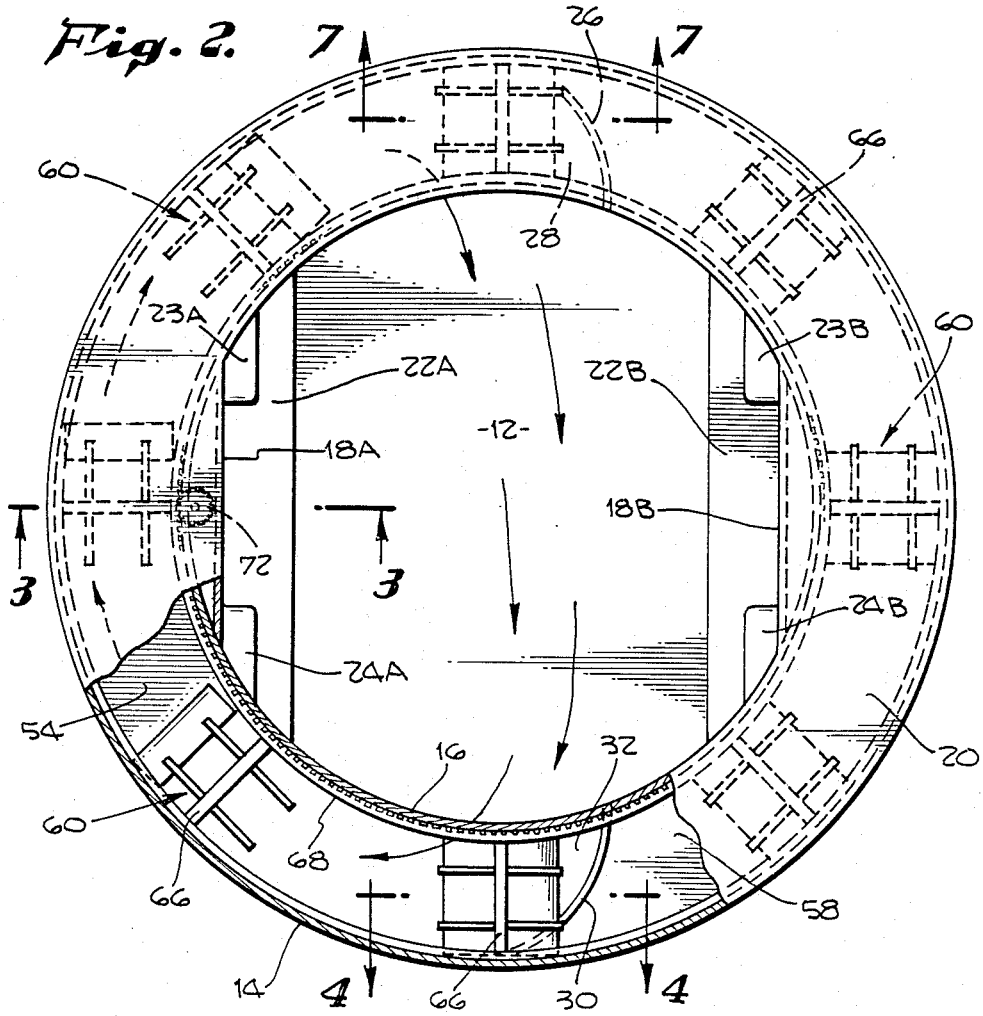
FIG. 2 is a top plan view of the apparatus of FIG. 1 with a portion of the cover plate deleted from the view.

Two benches or seats are provided inside the main water space 50. As best seen in FIG. 2 the seats 22A and 22B are opposite each other and equidistant from the water inlet and outlet openings. At the ends of bench 22A are steps 23A and 24A, while bench 22B has steps 23B, 24B at its ends. The purpose of the steps is to make it easy for persons using the apparatus to enter the water space 50. Typically the water W (see FIG. 3) will have a depth of about three feet and four inches. The bench height above bottom wall 12 is about 18 inches while the steps are another 18 inches above the tops of the benches.

There are two additional vertical walls, straight and not curved, associated with the benches. Wall 18A forms a back for bench 22A while wall 18B forms a back for bench 22B. A flat top cover 20 covers the space between outer wall 14 at the outer perimeter of housing, and the perimeter of water space 50 as defined by inner walls 16, 18A, and 18B. More specifically, the cover plate is of a generally ring-shaped configuration except that it is made wider where it extends to the walls 18, and at those locations its inner edge conforms to a secant of a circle, rather than the circle itself. See FIGS. 1-3.

Figure 3:
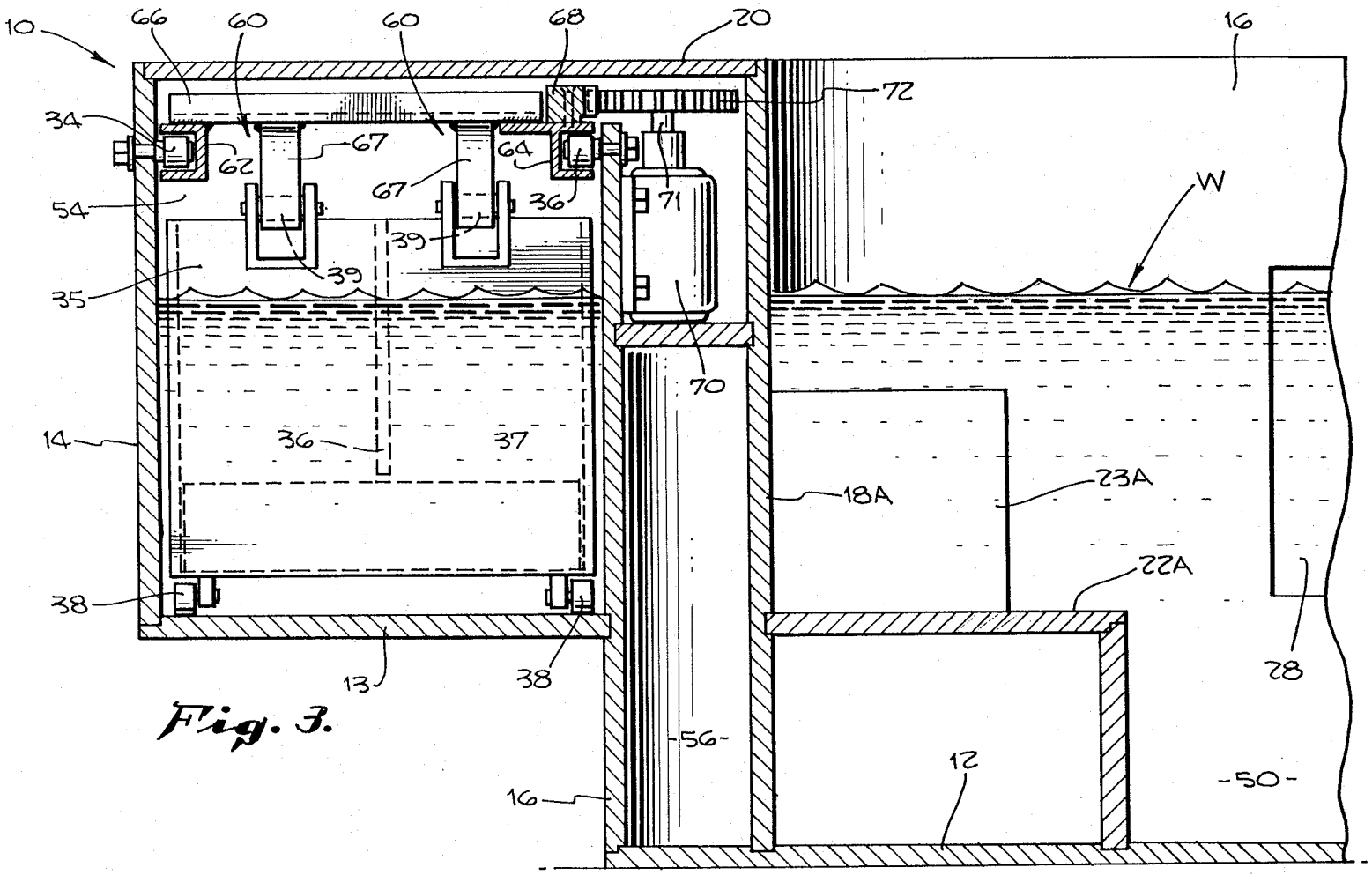
FIG. 3 is a vertical cross-sectional view taken on the line 3—3 of FIG. 2.

In the region adjacent bench 22A and wall 18A the circular inner vertical wall 16 has a portion of its upper edge cut away. See FIG. 3. It does, however, extend well above the water line. Space 56 between straight vertical wall 18A and the adjacent portion of curved vertical wall 16 is not filled with water. Within this space an electric motor 70, FIG. 3, is mounted for the purpose of driving the pumping apparatus. Motor 70 has a shaft 71 which extends vertically upward, and a fixed gear 72 on the upper end of shaft 72 lies in a horizontal plane.

The pumping apparatus is carried on a generally ring-shaped frame designated generally by the numeral 60. Frame 60 includes a circular outer rail 62 and a circular inner rail 64. The two rails are concentric. A set of eight identical spars 66 lie on equally spaced radii and tie the rails together. A large circular gear 68 having teeth on its interior surface is fixedly attached to the upper surface of the inner rail 64. The teeth of gear 72 driven by motor 70 engage the teeth of gear 68, thus causing the entire frame assembly to rotate within the housing 10. More specifically, it rotates within the annular space between walls 14 and 16, within the space 54 above water W, and within space 58 which contains no water.

Each of rails 62 and 64 is of U-shaped cross-sectional configuration, the open side of the U facing horizontally outwardly from the frame assembly 60. In order to support these rails from the housing, a plurality of rollers are attached in fixed positions to walls 14 and 16. Thus, a set of rollers 34, typically about sixteen in number, are attached to the interior surface of outer wall 14 in order to support outer rail 62 in rotatable relation therewith. And a similar set of rollers 36 are attached to the exterior surface of wall 16 to support inner rail 64 in rotatable relation.

It will therefore be seen that frame assembly 60 is capable of being driven in continuous rotation relative to housing 10 by the electric motor 70. According to the invention a set of flaps or pumping blades are carried by the frame assembly 60. Each flap or blade as it enters the space 54 adjacent outlet 32 is lowered into the water; it is then carried forward along a circular path at a constant velocity, driving the water before it as it moves; and then, before reaching obstacle 26 adjacent inlet opening 28, it is lifted out of the water. The flap or blade must then pass over the obstacle 26 and into the space 58, and thence over obstacle 30 before it is again lowered into the water. These flaps or blades will now be described, together with the apparatus for raising them, lowering them, maintaining them in fixed raised or lowered position, and for driving them in their circular path of motion.

There are eight of the flaps or pumping blades 35, one for each spar 66. See FIGS. 2-5. Each flap has a generally rectangular configuration, and rather than being in the form of a flat plate is arcuately curved in a longitudinal direction. On its under side the flap 35 has a longitudinally extending vertical stiffening rib 36, as shown in solid lines in FIGS. 4 and 5 and in dotted lines in FIG. 3. Its forward or nose portion 37 is weighted, as with lead weights.

Each spar 66 has a pair of roller guides 67 attached to its under surface and extending longitudinally, i.e., lengthwise of the annular space between walls 14 and 16. See FIGS. 2-4. On the upper surface of its rearward end each flap has attached to it a pair of rollers 39, FIGS. 5 and 6. Each of the rollers 39 rides within one of the guides 67, FIG. 6. Each of the guides is curved along its length, being of highest elevation in the center of its length with its two ends being at lower elevation. Thus, each flap 35 is free to move longitudinally back and forth relative to the rotating assembly 60, and in doing so its rearward end moves first upward and then downward.

Figure 4:
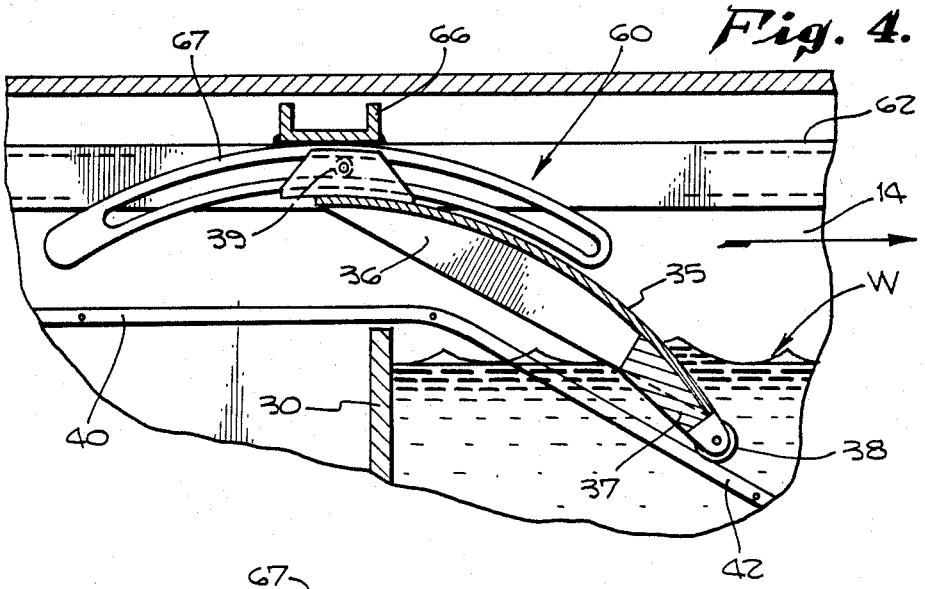
FIG. 4 is a vertical cross-sectional view taken on the line 4—4 of FIG. 2, showing a particular flap or impeller blade about to engage the water.
Figure 6:
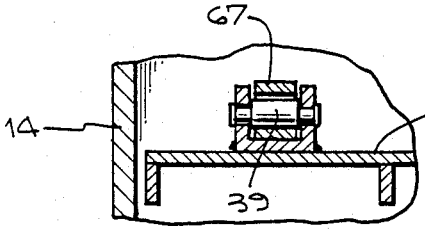
FIG. 6 is a fragmentary cross-sectional view taken on the line 6—6 of FIG. 5.

Each flap 35 also carries on the lower corners of its forward end a pair of support rollers 38, FIGS. 3 and 4. These rollers provide vertical support for the forward end of the flap, and in conjunction with the weight 37, permit the forward end of the flap to change its elevation from time to time as the flap traverses around the annular space between the walls 14, 16. Tracks are provided by the housing 10 in order to support these rollers 38 and thereby control the vertical movements of the forward end of the flap.

Figure 5:
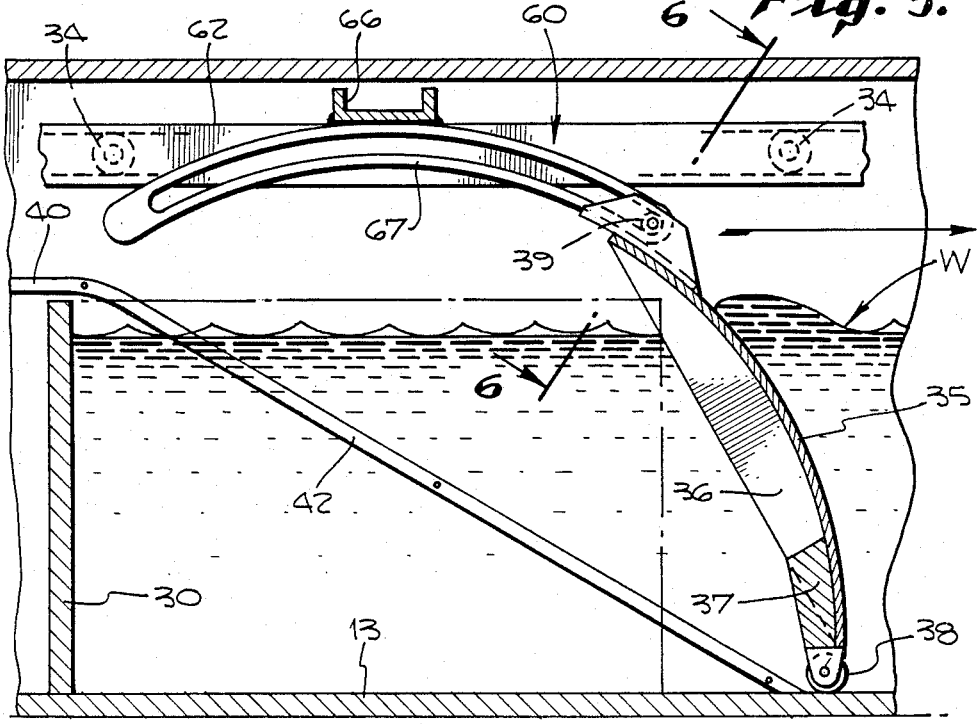
FIG. 5 is a view like FIG. 4, but after the flap or blade has fully engaged the water.
Figure 8:
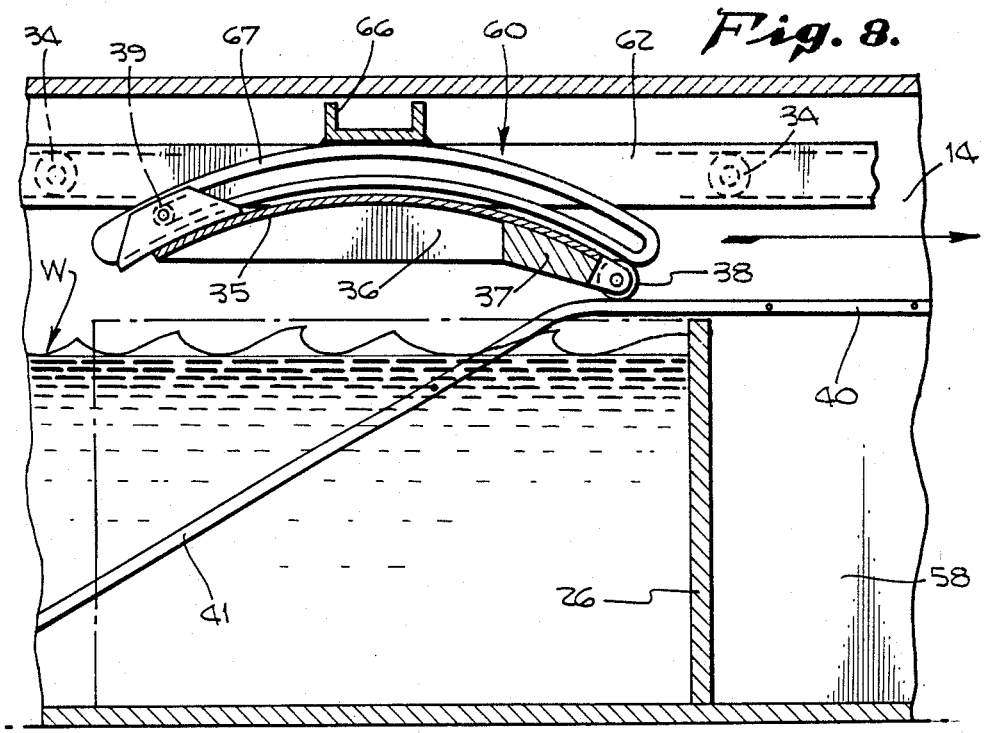
FIG. 8 is a view like FIG. 7 showing the flap or blade in fully retracted position.
Figure 7:
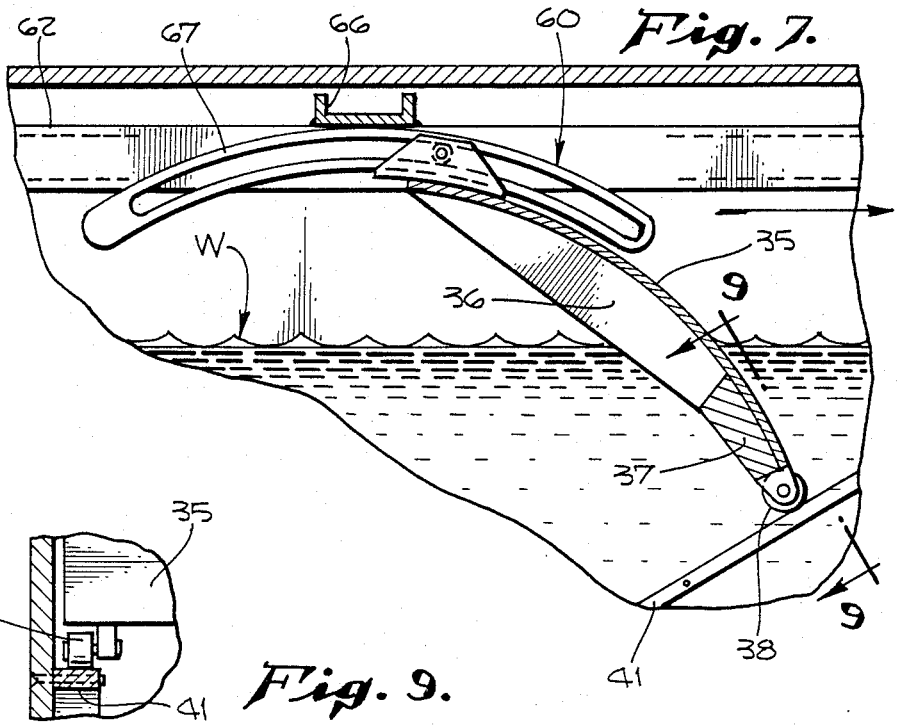
FIG. 7 is a vertical cross-sectional view taken on the line 7—7 of FIG. 2 and showing a flap or blade as it is being retracted from the water.
Figure 9:
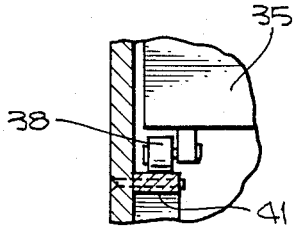
FIG. 9 is a fragmentary cross-sectional view taken on line 9—9 of FIG. 7.

When the flap 35 moves forward through the water pumping compartment or return passageway 54 its forward rollers 38 rest directly upon the bottom plate 13, FIG. 3, so that the flap is inclined at an angle of about 30 degrees to the vertical, see FIG. 5. However, when passing through the space 58 on the opposite side of housing 10 the flap has its forward end supported by tracks 40, FIGS. 4 and 8, so that the flap is substantially horizontal and is longitudinally substantially coextensive with its supporting roller guides 67. When the flap leaves compartment 54 its forward rollers are raised by upwardly inclined rearward ends 41 of the tracks 40, FIGS. 7 and 8. When it again enters compartment 54 its rollers are permitted to drop down by the downwardly inclined forward ends 42 of the tracks, FIGS. 4 and 5. Tracks 40 are permanently attached to the inside of the outer wall 14 and the outside of the inner wall 16, respectively.

OPERATION OF PREFERRED EMBODIMENT

Figure 1:
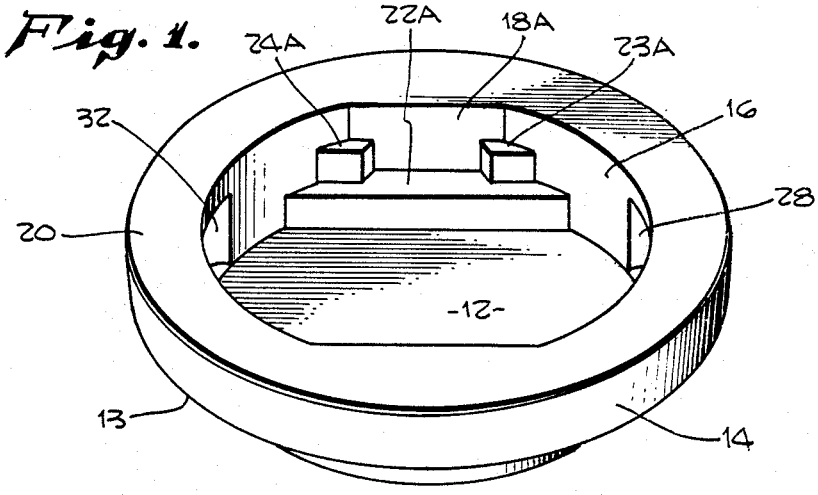
FIG. 1 is a perspective view of the presently preferred apparatus in accordance with my invention.

The operation of the presently preferred embodiment of the invention is as follows. When motor 70 is turned on, it slowly accelerates the circulating movement of the water. A smooth flow path is provided in the space 54 between walls 14, 16. Obstacle 26, FIGS. 2 and 10, in conjunction with inlet opening 28, FIGS. 1, 3, and 10, provides a smooth although curved path of flow, so that the water experiences substantially laminar rather than turbulent flow. As the water passes through the interior space 50 some turbulence is experienced, since a much wider pathway is presented. Nevertheless, a relatively smooth flow is achieved. The water flows out through outlet opening 32 guided by obstacle 30 which, like obstacle 26, is smoothly curved so as to avoid any abrupt change in the flow path. The water then reenters the return passageway 54.

The flaps or impeller blades 35 move forward within space 54 in an evenly spaced series. In its fully lowered position as shown in FIG. 5 each flap is totally effective in moving the water in front of it. There is, of course, a minor amount of leakage or retroflow around the sides and bottom of the flap, but the flap nevertheless effectively displaces the entire volume of water and moves it forward. Since there is a series of these flaps working in concert, the action is very effective. As motor 70 achieves full speed the entire circulating body of water has also achieved full speed and a high level of kinetic energy. The entire flow path for the circulating water is of substantially uniform cross-sectional area since the water flows mainly in the center portion 52 of space 50. Thus the energy loss that is required to drive the water circulation is minimized. The water can be circulated at a suitable swimming speed with only a very reasonable energy consumption. The smooth shape of obstacles 26 and 30 is significant in this regard.

For the swimmer all the water flowing through the space 52 in which he swims is at substantially the same velocity, so he experiences substantially the same water velocity on all parts of his body. Of course in the side areas of space 50 the water movement is much slower. The moving water to which the swimmer is exposed, however, closely simulates the traditional swimming environment in which the swimmer moves while the water stays stationery. A control is provided for the motor 70 to regulate its speed, so that the swimmer can achieve the water speed and hence the swimming speed that he desires.

SECOND EMBODIMENT

Figure 12:
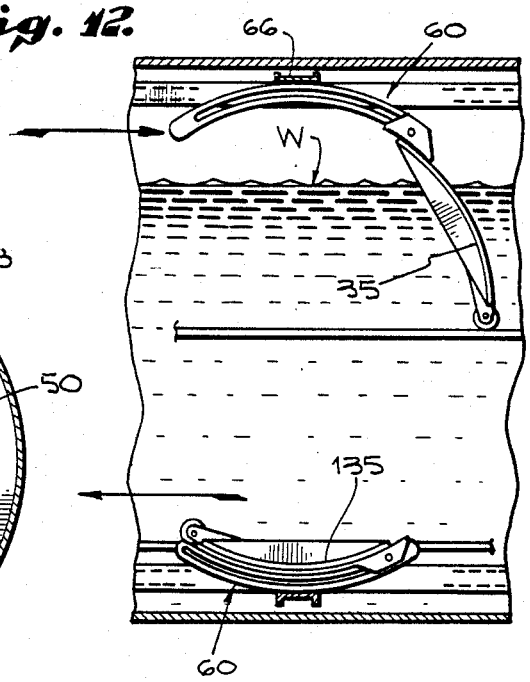
FIG. 12 is a vertical cross-sectional view taken on the curved line 12—12 of FIG. 11, showing both upper and lower flaps in one position.
Figure 11:
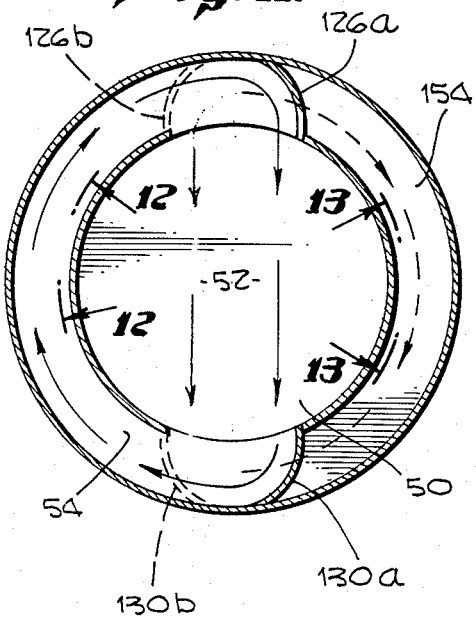
FIG. 11 is a schematic view of an alternate or modified form of the invention, in which water is pumped through generally parallel return paths on both sides of the swimming space.
Figure 13:
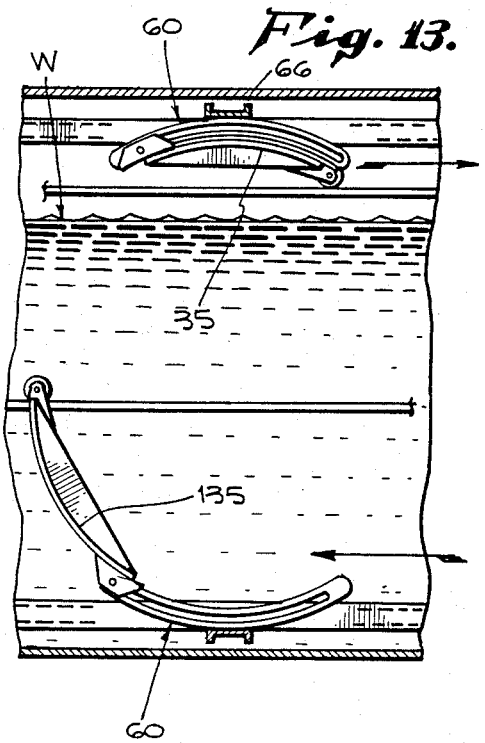
FIG. 13 is a vertical cross-sectional view taken on the curved line 13—13 of FIG. 11 showing a different position of the upper and lower flaps.

Reference is now made to FIGS. 11 through 13 illustrating a second embodiment of the invention. In this embodiment the space 58 becomes a second water return or pumping passageway 154. THus, water is pumped through the two passageways 54, 154 parallel. Obstacle 126 at the water inlet has two separate parts **126*a*, 126*b*. Part 126*a* is at a higher elevation and guides the water from space 54 into the swimming space 50, while obstacle part 126*b* is at a lower elevation and guides the water from space 154 into the swimming space. Thus, the water is guided from both sides in curved pathways into the inner space 50. Similarly, obstacle 130 at the water outlet is of a similar configuration so as to cause the water to divide into two paths for the spaces 54 and 154, respectively. The result then is that a larger flow of water is delivered to the swimming space 52**.

In order to drive the water flow, two ring-shaped frames are required, rotating in mutually opposite directions. In the abbreviated illustration shown, flap 35 is supported from the upper rotating ring while flap 135 is supported from the bottom rotating ring. FIG. 12 shows the action within the space 54, where flap 35 is driving water toward inlet opening obstacle 126 while the lower flap 135 is retracted. FIG. 13 shows the action within the space 154 where flap 35 is retracted while flap 135 drives water toward the inlet opening.

A typical energy equation for the illustrated embodiments of my invention is:

$$H_T = H_{FM} + H_{FW} + H_{CR} + H_{DV}$$

Where $H_T$ = Total Energy Loss;

$H_{FM}$ = Mechanical Friction Energy Loss (mechanical apparatus only;

$H_{FW}$ = Water Friction Energy Loss (between water and walls);

$H_{CR}$ = Water Head Energy Loss Due to Curves in Water Flow Path; and $H_{DV}$ = Water Head Energy Loss Due to Velocity Changes Caused By Viscosity Between Main Stream and Still Water in the Swimming Section.

OTHER ALTERNATE FORMS

There are many other alternate forms of my invention. It is important that the cross-sectional area, in total, of the pumping pathway or pathways, be substantially equal to the cross-sectional area of the actual swimming space that is occupied by the swimmer's body, or at the very least that the two areas are roughly comparable. By maintaining the size of the pathway more or less constant the problem of turbulent flow and loss of pumping energy is diminished.

It is even more important that the water flow through the space occupied by the swimmer be at a substantially constant rate for all parts of the swimmer's body. This provides him with a comfortable swimming condition which simulates that of a conventional swimming pool. This result is accomplished by providing an inlet opening which is comparable in width and height to the space that would be actually occupied by a swimmer's body, and driving the water through the inlet opening at a velocity which is substantially constant throughout its entire cross-sectional area.

In accomplishing the objects of my invention it is also greatly preferred to utilize displacement pumping, since this is much more energy efficient once the full water speed has been achieved.

Various mechanisms may be utilized for the alternate forms of my invention. While the cross-sectional area of the flow path may be allowed to vary somewhat, it is undesirable to raise or lower the water by any significant amount, as this requires additional energy and may disturb the smooth or laminar flow without a corresponding benefit.

While the illustrated embodiments of my invention utilize an annular cavity for generating the water flow, other types of pathways may be used if so desired.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A displacement pumping method of operating a high flow, low turbulence swim-in-place pool, comprising the steps of:

(a) selecting a water-containing pathway in the form of a closed horizontal loop which includes both an open swimming space and a water pumping and return channel;

(b) forming an inlet means at one end of said swimming space for receiving water from said channel and an outlet means at the other end of said swimming space for returning water to said channel, such that water can be circulated through said loop;

(c) selecting a plurality of more than three impeller blades;

(d) arranging at least three of said impeller blades in a longitudinally spaced series;

(e) immersing said series of impeller blades in the water in said pumping and return channel by orienting said blades nearer to the vertical than the horizontal;

(f) advancing said at least three impeller blades of said series along said channel in unison and at constant velocity so that a substantially fixed body of water is captured between each two adjacent blades and advanced with the blades;

(g) as the foremost one of said series of impeller blades approaches said inlet, retracting it from the water in said channel by raising it out of said water such that it is oriented nearer to the horizontal than the vertical; and (h) when the foremost blade is retracted from the water, inserting another one of said plurality of impeller blades into the water within said pumping and return channel near said outlet by orienting it from a near horizontal to a near vertical position so as to then become the rearmost blade of the series.

2. The method of claim 1 wherein said pumping and return space forms an arc of a circle and said swimming space forms a diameter of the same circle.

3. The method of claim 1 wherein the water pumping and return channel is selected to have a cross-sectional area which is comparable to that portion of the cross-sectional area of the swimming space that a swimmer's body will necessarily occupy.

4. The method of claim 1 wherein the impeller blades are inserted into the water in an angular position which is generally perpendicular to the path of water flow through the pumping and return channel, but not precisely so, and are maintained at that angular position as they are advanced.

5. The method of claim 4 wherein the angular position of the impeller blades is about thirty degrees away from being perpendicular to the path of water flow.

6. The method of claim 1 wherein the impeller blades of the immersed series of blades are evenly spaced apart.

7. The method of claim 1 wherein the water pumping and return channel is selected to be of uniform size and shape throughout its length, and the impeller blades are so selected as when immersed to fill substantially the entire cross-sectional area of said channel, so that as the impeller blades are advanced within said channel each impeller blade effectively displaces the entire volume of water in front of it and moves it forward.

* * * * *